US008166730B2

(12) United States Patent
Schmatz

(10) Patent No.: US 8,166,730 B2
(45) Date of Patent: May 1, 2012

(54) DEVICE FOR CLOSING CONTAINERS WITH SCREW CAPS INCLUDING QUICK CHANGE MECHANISM FOR CLOSING ELEMENT

(75) Inventor: Stefan Schmatz, Bernhardswald (DE)

(73) Assignee: Krones AG, Neutraubling (DE)

( * ) Notice: Subject to any disclaimer, the term of this patent is extended or adjusted under 35 U.S.C. 154(b) by 191 days.

(21) Appl. No.: 12/664,904

(22) PCT Filed: Apr. 2, 2008

(86) PCT No.: PCT/EP2008/002603

§ 371 (c)(1),
(2), (4) Date: Apr. 21, 2010

(87) PCT Pub. No.: WO2008/154973

PCT Pub. Date: Dec. 24, 2008

(65) Prior Publication Data

US 2010/0205905 A1 Aug. 19, 2010

(30) Foreign Application Priority Data

Jun. 20, 2007 (DE) ..... 10 2007 028 429

(51) Int. Cl.
*B67B 3/20* (2006.01)

(52) U.S. Cl. ..... 53/331.5; 53/317

(58) Field of Classification Search ..... 53/317, 53/331.5; 403/294, 321, 325, 326, 331; *B67B 3/20*
See application file for complete search history.

(56) References Cited

U.S. PATENT DOCUMENTS

| | | | | | |
|---|---|---|---|---|---|
| 4,996,826 | A * | 3/1991 | Pfaffmann et al. | ..... | 53/478 |
| 5,167,478 | A * | 12/1992 | Ramunas | ..... | 403/331 |
| 5,203,595 | A * | 4/1993 | Borzone et al. | ..... | 403/331 |
| 5,479,762 | A * | 1/1996 | Bliss | ..... | 53/331.5 |
| 5,607,250 | A * | 3/1997 | Tatterson et al. | ..... | 403/331 |
| 5,884,450 | A * | 3/1999 | Ronchi | ..... | 53/331.5 |
| 6,216,340 | B1 * | 4/2001 | Fassbind et al. | ..... | 29/773 |
| 6,840,024 | B2 * | 1/2005 | Ronchi | ..... | 53/331.5 |
| 2001/0054273 | A1 | 12/2001 | Gruson | | |

FOREIGN PATENT DOCUMENTS

| | | | |
|---|---|---|---|
| DE | 19755727 | C1 | 1/1999 |
| DE | 10124659 | A1 | 12/2002 |
| EP | 1245525 | A1 | 10/2002 |

* cited by examiner

*Primary Examiner* — Stephen F Gerrity
(74) *Attorney, Agent, or Firm* — Marshall, Gerstein & Borun LLP

(57) ABSTRACT

A device for closing containers, particularly bottles, with screw caps, having at least one rotatably drivable closing head in which a closure-specific closing element is exchangeably retained, a positive-fit quick-change mechanism for the respective closing element is embodied in the closing head, and in the release state of the quick-change mechanism the closing element can be laterally removed or inserted essentially perpendicular to the rotational axis of the closing head.

14 Claims, 2 Drawing Sheets

DEVICE FOR CLOSING CONTAINERS WITH SCREW CAPS INCLUDING QUICK CHANGE MECHANISM FOR CLOSING ELEMENT

CROSS-REFERENCE TO RELATED APPLICATION

The present application claims the benefit of priority of International Patent Application No. PCT/EP2008/002603, filed Apr. 2, 2008, which application claims priority of German Patent Application No. 10 2007 028 429.4, filed Jun. 20, 2007. The entire text of the priority application is incorporated herein by reference in its entirety.

FIELD OF THE DISCLOSURE

The present disclosure relates to a device for application of screw cap enclosures, such as in beverage bottling operations.

BACKGROUND

In such devices that are used in practice, for instance for closing PET bottles with screw caps, for example, of the type known from DE-A-101 24 659, the closing element used must be screwed together with a fitting sleeve downwards out of the closing head upon change to another type of screw cap. Since different bottle conveying and treating components, e.g. round neck-guiding plates, of which at least some must be exactly adjusted to the closing head, are installed underneath the closing head and relatively close to said head, the change of the closing element requires the disassembly of at least some components so as to provide space and access downwardly, as well as subsequent new adjusting operations. This calls for considerable set-up times and is a difficult job carried out with tools. Since it often happens that even bottles of the same producer have different screw caps, although the bottles are always the same, i.e. after a closing-element change they would actually not require any adjusting of the components adjoining the closing head, the long setting times matter a lot. Moreover, with frequent closing-element changes there arises the risk of seizure of the thread with which the closing element is fixed in the closing head.

SUMMARY OF THE DISCLOSURE

It is the object of the present disclosure to provide a device of the aforementioned type enabling a fast change of the closing element without disassembly of components adjoining the closing head, for instance a neck star or round guide plates.

The closing element is not directly held in the closing head, but in the quick-change mechanism, which is however configured such that the closing element is essentially perpendicular to the rotational axis of the closing head and can be laterally removed or inserted. Such a change can be carried out swiftly, resulting in a very short set-up time as no adjoining components have to be disassembled and then readjusted again. On the side of the closing head, and above the adjoining components, there is enough space for an easy manipulation. The quick-change mechanism can be used for different closing-head systems, e.g. both for plunger and stop systems, and can also be used for segmented closing elements.

In an expedient embodiment the respective closing element is held in a change member of the quick-change mechanism and is inserted or removed together with the change member. The change member is coupled in a force and motion transmitting manner via the positive coupling of the change member with the permanently fixed accommodating means remaining in the closing head. This positive coupling can be laterally disengaged for changing purposes and in the release state of the quick-change mechanism. An additional advantage is here that the thread in the closing head is no longer subject to wear because the accommodating means must be disassembled, if at all, only on rare occasions. The accommodating means of the change member can fit different screw caps. As an alternative, clearly different screw caps can belong to different change members.

A particular advantage of the device is that the quick-change mechanism can be operated by hand and without any tools. A change can be carried out with a few simple operations and without the application of a considerable force.

Expediently, the positive coupling is even configured such that disassembly or insertion of the change member can be carried out from two sides that are diametrically opposite with respect to the rotational axis of the closing head. Since in the area where the change member is laterally removed or inserted, there is normally a very good accessibility for the changing operation, e.g. over about 300°, the closing head coupled with a gearing for a plurality of closing heads need possibly not be rotated at all for a changing operation because one side is always accessible for the changing operation.

In an expedient embodiment the accommodating means is a tubular section that can be fixed in the closing head, preferably a tubular section with an external thread and a fitting cone at one end. At the other end of the accommodating means a mount is formed that comprises a first member of the positive coupling. The change member may be a hollow body that at one end comprises a second member of the positive coupling and in the other end the accommodating means for the closing element.

For an easy handling the change-member securing means may comprise a ring which is axially displaceable on the mount on the outside and grips in the locking position on the outside over both interengaged members of the positive coupling, thereby preventing an unintended release of the positive coupling and centering the change member neatly on the accommodating means and the closing head, respectively.

Expediently, axially spaced-apart stops between which the ring can be axially reciprocated are provided on the accommodating means and on the change member. To make sure that under operationally caused vibrations the ring does not move in an uncontrolled manner into the release state, it is expedient to bias the ring towards the locking position by spring force. The spring force must only be so great that the ring cannot independently abandon its locking position, but can be moved easily by hand into the release state. Upon removal of the change member, however, the ring should remain secured on the accommodating means.

Under mounting aspects at least the stop on the accommodating means is advantageously a circlip or another suitable stop that can be mounted and removed easily if the quick-change mechanism has to be disassembled.

In an expedient embodiment the positive coupling is configured in the manner of a dovetail guide that is oriented essentially perpendicular to the rotational axis of the closing head. Said guide is provided preferably at one end of the hollow body on the outside with two parallel-extending, straight grooves defined by outer webs, and on the mount on the inside with two grooves extending in parallel relative to each other and being defined by interior webs. The webs are linearly slid into the grooves. This yields a stable mounting of the change member with large force transmitting surfaces and has the advantage that the positive coupling can be easily released or engaged by applying a small force. Optionally, a plurality of groove and web pairs are provided, e.g. each offset by 60° or 120° in circumferential direction in the mount and/or on the change member, so as to find a suitable change position in an easy way without rotating the closing head.

To be able to remove the closing element in an easy way from the change member, it is expedient when the change member comprises a spring lock for the inserted closing element in the accommodating means.

Expediently, the accommodating means, the change member and the ring are shaped parts of plastics or metal.

Furthermore, it might be expedient when some kind of locking, e.g. a ball locking, is arranged for centering the change member on the accommodating means in the dovetail guide, the locking additionally or basically ensuring a centering of the change member on the accommodating means.

The accommodating means should have circumferentially distributed cleaning openings, so that the cleaning head can be easily rinsed and cleaned, as is customary.

BRIEF DESCRIPTION OF THE DRAWINGS

An embodiment of the subject matter of the disclosure will now be explained with reference to the drawings, in which.

DETAILED DESCRIPTION OF THE PREFERRED EMBODIMENT

Figure 1:
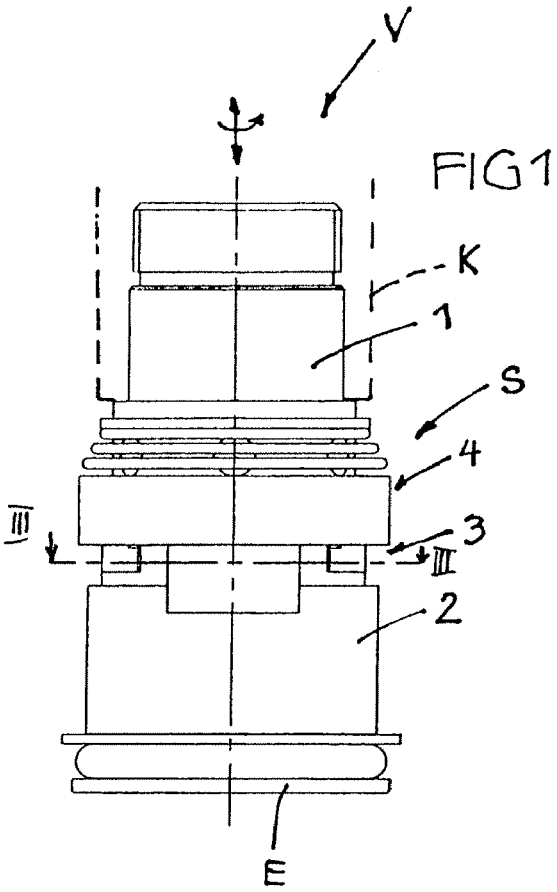
FIG. 1 is a side view showing a device for closing containers, particularly bottles, with screw caps, wherein a quick-change mechanism is shown in an operative position shortly before a change.

Of a device V for closing containers, for example PET bottles, in a closing device of a bottling system, FIG. 1 shows a lower part of a closing head K in broken line. The closing head K can be driven in axial direction and/or in rotational direction to mount a screw cap, which is positioned in a closing element E, on the external thread of the bottle neck of a bottle positioned underneath the closing head K. To position and convey the containers, components (not shown in FIG. 1) are provided next to the closing head and underneath said head.

Figure 2:
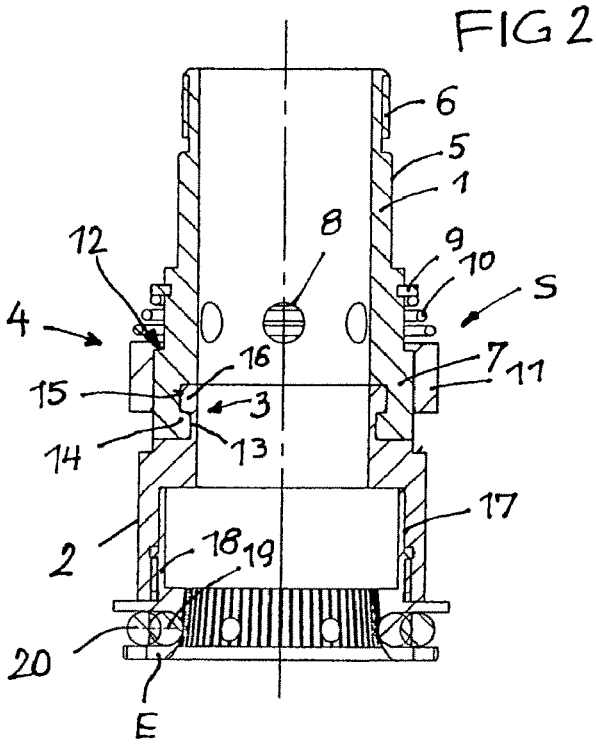
FIG. 2 is a longitudinal section through the quick-change mechanism of FIG. 1.

In FIG. 1 the closing head K is equipped with a quick-change mechanism S for exchangeably holding the respective closing element E. Main components of the quick-change mechanism S in FIG. 1 (see also FIG. 2 in a longitudinal section) are an accommodating means 1, a change member 2 in which the closing element E is held, a positive coupling 3 of the change member, and a change-member securing means 4. The quick-change mechanism S is preferably operable by hand without any tool and, upon insertion or removal of the closing element E with the change member 2, the mechanism enables a lateral movement of said members, i.e. in a direction perpendicular to the rotational axis of the closing head K.

The accommodating means 1 (FIG. 2) is a tubular section having a fitting cone 5 and an external thread 6 on one end and a mount 7 on the other end. Circumferentially distributed cleaning openings 8 may be provided in the accommodating means 1. On the outside a stop 9, e.g. a circlip, is provided on the accommodating means 1 and supports a spring 10 acting on an axially displaceable ring 11 of the change-member securing means 4 towards a locking position. A further stop 12 limiting the path of movement of the ring 11 is e.g. formed on the mount 7, e.g. in the form of a surrounding shoulder.

Figure 5:
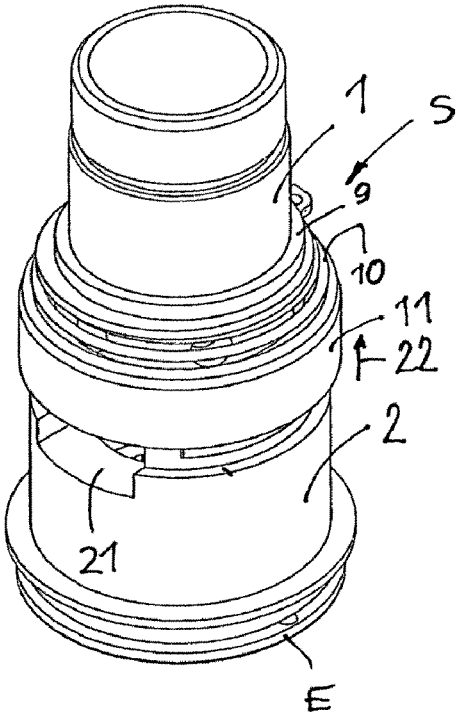
FIG. 5 is a perspective view of the quick-change mechanism in the operative position of FIG. 1.
Figure 6:
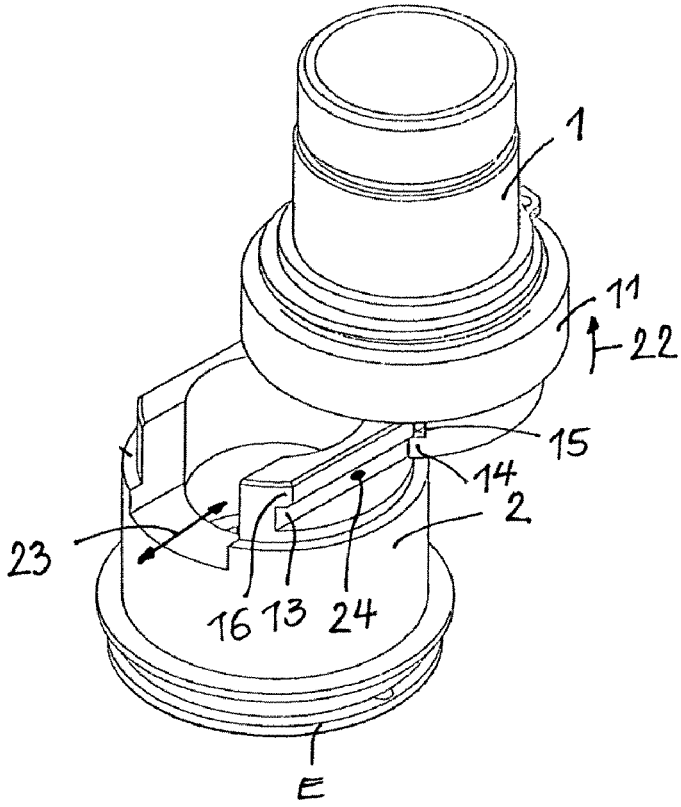
FIG. 6 is a perspective view of the quick-change mechanism while carrying out a changing operation.

The laterally releasable and engageable positive coupling 3 of the change member is configured in the form of a straight dovetail guide and is composed of two parts. The one part, i.e. two linearly extending grooves 13 that are in parallel with each other and are upwardly defined by straight webs 16, is formed in the upper end of the change member 2. The other part of the positive coupling 3 of the change member is constituted by two grooves 15 that are here U-shaped and in parallel with each other and are continuously formed on the inside into the mount 7 and are defined on the bottom side by webs 14 that are also straight and continuous. The webs 14, 16 are inserted or removed with a straight movement (part 23 in FIG. 6). The grooves 15, 13 are open either on the side positioned at the rear in the drawing plane of FIG. 2 or on the side positioned at the front, or on both sides, so that the change member 2 in FIG. 2 can be separated laterally upwards or downwards from the accommodating means 1. The ring 11 is shown in a position in which it does not yet permit a separation of the accommodating means 1 from the change member 2. For changing purposes the ring 11 must be moved upwards in the direction of an arrow 22 (FIGS. 5 and 6). If necessary, several groove and web pairs are provided, the pairs being offset circumferentially relative to one another. Furthermore, any desired cross section may be chosen for the grooves and the webs.

An accommodating means 17 for the closing element E is formed in the lower end of the change member 2. The closing element E is seated e.g. with a hollow attachment 18 in the accommodating means 17 and comprises an inner cone for accommodating a screw cap that is held by balls 19 acted upon radially inwards by an O-ring 20.

Figure 3:
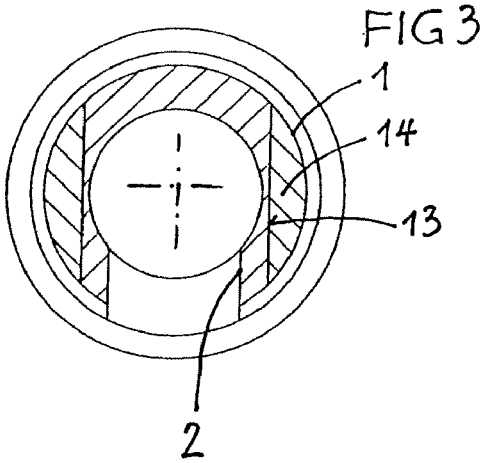
FIG. 3 is a section taken through the quick-change mechanism in the sectional plane III-III in FIG. 1.

In the section shown in sectional plane in III-III in FIG. 1, it can be seen in FIG. 3 that the grooves 13 end freely at the front and rear so as to be able to separate the change member 2 in FIG. 3 either downwards or upwards from the accommodating means 1.

Figure 4:
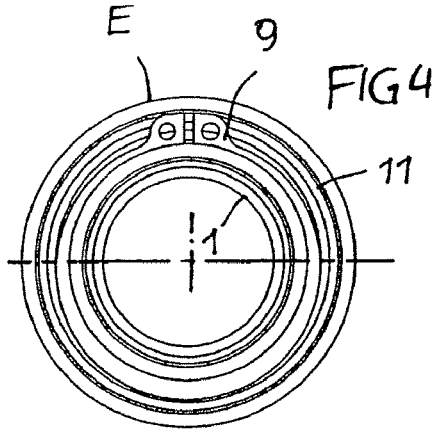
FIG. 4 is a top view on the quick-change mechanism in FIG. 2.

It can be seen in the top view (in FIG. 2 from above) according to FIG. 4 that the stop 9 is formed by a circlip or a similar stop ring and that a flange of the closing element E projects outwards. FIG. 4 is a view onto the upper end of the accommodating means 1.

In the perspective view of the quick-change mechanism S in FIG. 5, the ring 11 is slightly pushed upwards in the direction of the arrow 22 against the spring 10 towards the upper stop 9, just to such an extent that the positive coupling 3 cannot be released yet. The change member 2 may e.g. comprise lateral cutouts 21 for reasons of processing.

To be able to separate the change member 2 with the closing element E laterally in the direction of the double-headed arrow 23 (FIG. 6) from the accommodating means 1, the ring 11 according to FIG. 6 is even pushed slightly further in the direction of the arrow upwards, and the change member in the dovetail guide with the web 16 is linearly pulled out of the groove 15 while the web 14 is sliding out of the groove 13.

A lock 24 that centers the change member 2 already on the accommodating means 1 when the ring 11 has not been shifted downwards yet is provided in the dovetail guide if necessary.

For the insertion of another change member 2 the ring 11 is first shifted upwards in the direction of the arrow 22 until the groove 15 of the accommodating means 1 is exposed, and the web 16 is threaded into the groove 15 and the web 14 is simultaneously threaded into the groove 13 before the change member 2 is inserted to be aligned with the rotational axis of the closing head K and the accommodating means 1, respectively. The ring 11 is then released, so that it slides under the action of the force of the spring 10 automatically downwards, e.g. down to stop 12, and secures the coupling against release. If necessary, manual assistance is provided when the ring 11 is slid downwards.

The parts of the quick-change mechanism may be shaped parts of plastics or also of metal. Furthermore, change members of different sizes or of different designs with respect to their accommodating seats may be used for distinctly different screw caps, but all of said change members have the same one part of the positive coupling. Upon a change there is no need for disassembling or shifting any components installed underneath the closing head K. In case only different screw caps are processed for the same type of container or bottle, new adjusting operations are also not required for said components upon a changing operation. It would even be possible to form the closing element E directly with the one coupling member or to insert it without the change member 2.

I claim:

1. A device for closing containers with screw caps, comprising at least one rotatably drivable closing head, in which a closure-specific closing element is exchangeably retained, a positive-fit quick-change mechanism for the respective closing element is embodied in the closing head and that in a release state of the quick-change mechanism the closing element can be laterally one of removed or inserted essentially perpendicular to the rotational axis of the closing head.

2. The device according to claim 1, wherein the respective closing element is retained in a change member of the quick-change mechanism, and that for the change member an accommodating means remaining in the closing head is equipped with a positive coupling of the change member that is releasable in a lateral direction and a change-member securing means that is switchable between a locking position and the release state.

3. The device according to claim 2, wherein the positive coupling is one of releasable or engageable with straight movements for removing or inserting the change member from two sides that are diametrically opposite with respect to the closing head.

4. The device according to claim 2, wherein the accommodating means is a tubular section that is fixable in the closing head and a fitting cone on one end and a mount on the other end, wherein the mount comprises a first member of the positive coupling, and the change member is a hollow body that on one end comprises a second member of the positive coupling and in the other end an accommodating means for the closing element.

5. The device according to claim 4, wherein the change-member securing means comprises a ring which is displaceable on the outside on the mount of the accommodating means axially between the locking position and the release state, the ring gripping in the locking position on the outside over both members of the positive coupling that are engaged with one another.

6. The device according to claim 5, wherein the accommodating means and the change member have provided thereon axially spaced apart stops between which the ring can be moved back and forth, and that the ring is biased by spring force towards the locking position.

7. The device according to claim 6, wherein the stop on the accommodating means is one of a removable circlip or similar stop ring.

8. The device according to claim 5, wherein the accommodating means, the change member, and the ring are shaped parts formed of one of plastics or metal.

9. The device according to claim 4, wherein the tubular section has an external thread.

10. The device according to claim 4, wherein the positive coupling comprises at least two grooves that extend as a pair on an end of the hollow body on the outside in parallel with each other and are straight and defined by external webs, and, on the mount on the inside, two grooves extend in parallel with each other and are defined by interior webs, the interior webs being linearly displaceable in the grooves.

11. The device according to claim 2, wherein the positive coupling is designed in the manner of a dovetail guide oriented essentially in a direction perpendicular to the rotational axis of the closing head.

12. The device according to claim 11, wherein a ball lock is provided for centering the change member on the accommodating means in the dovetail guide.

13. The device according to claim 2, wherein the accommodating means comprises circumferentially distributed cleaning openings.

14. The device according to claim 1, wherein the quick-change mechanism can be operated by hand and without any tool.

* * * * *